United States Patent [19]

Henig

[11] 3,974,057

[45] Aug. 10, 1976

[54] ELECTRO PLATING BARREL

[76] Inventor: Hans Henig, Parsifalstrasse 6, Nuremberg 85, Germany

[22] Filed: Jan. 28, 1974

[21] Appl. No.: 437,307

Related U.S. Application Data

[63] Continuation of Ser. No. 216,446, Jan. 10, 1972, abandoned.

[30] Foreign Application Priority Data

Jan. 13, 1971 Germany ..... 2101332

[52] U.S. Cl. ..... 204/213; 118/418; 134/159; 204/214; 259/89

[51] Int. Cl.[2] ..... C25D 17/20

[58] Field of Search ..... 204/213, 214; 134/157, 134/159; 118/418; 259/89

[56] References Cited

UNITED STATES PATENTS

| | | | |
|---|---|---|---|
| 1,291,830 | 1/1919 | Giuliana | 204/213 |
| 3,159,560 | 12/1964 | Belke | 204/213 |
| 3,330,753 | 7/1967 | Hepfer | 204/213 |
| 3,379,631 | 4/1968 | Henig | 204/213 |

FOREIGN PATENTS OR APPLICATIONS

| | | | |
|---|---|---|---|
| 722,012 | 6/1942 | Germany | 204/213 |
| 1,204,902 | 9/1970 | United Kingdom | 204/213 |

*Primary Examiner*—John H. Mack
*Assistant Examiner*—A. C. Prescott
*Attorney, Agent, or Firm*—Pierce, Scheffler & Parker

[57] ABSTRACT

An electroplating barrel for immersion in an electroplating electrolyte or other treatment liquid and for tumbling therein a bulk-mass of small parts, made of either electrolessly metal-coated plastics (synthetic resins) or of metals. The tumbling barrel consists essentially of a pair of spaced end walls, an annular treatment chamber defined by inner and outer peripheral walls between the end walls, and cathodic contacts, the length of the barrel being significantly less than the average overall diameter thereof.

8 Claims, 6 Drawing Figures

ELECTRO PLATING BARREL

This application is a continuation of application No. 216,446, filed Jan. 10, 1972, now abandoned.

BACKGROUND OF THE INVENTION

1. Field of the invention

This invention relates to certain new and useful improvements in apparatus for electroplating bulk parts.

2. Description of the prior art.

The electroplating of small metal or plastics parts on an industrial scale is today more and more widely carried out, for reasons of economy, in bulk within bell or drum-shaped containers. It is then possible for a bulk-mass of the small parts to be loaded into the containers, which being perforated can be partly dipped or wholly immersed in the appropriate electrolytes or other treatment liquids, and rotated therein. It has to be borne in mind that before the start of the electroplating process proper it is or may be necessary chemically to roughen the surface of bulk-parts made of plastics, generally by etching their surfaces, and thereafter to coat the roughened surfaces and render them electrically conductive by subsequent so-called electroless metal-deposition of a metallic layer. The conventional perforated bell-shaped or drum-shaped containers used for these purposes are generally known as tumbling barrels, and there are a variety of such conventional tumbling barrels which differ in their construction, dependent especially upon their intended use, above all according to whether they are meant for electroplating bulk parts made of metals or of plastics. The different forms of construction of the conventional tumbling barrels are thus influenced by the various properties which characterize the particular kind of bulk parts under treatment, above all by whether they are formed of metals or of plastics. There are no known tumbling barrels which are capable, with a standard constructional shape and unaltered method of operation, of properly satisfying the functional requirements which are both necessary and desirable for selectively bulk-electroplating parts made either of metals or of plastics in one and the same tumbling barrel.

In order clearly to see the deficiencies in the tumbling barrels of the prior art and to recognize the advantages of the solution provided according to the present invention it is convenient first to define those requirements which must be met for electroplating bulk parts made of plastics but to which an electroless-deposited metallic coating has been applied - because for the most part the same requirements are also of critical significance for the bulk-electroplating of parts made of metal.

When electroplating a bulk-mass of parts made of plastics and covered with an electrically-conducting metal layer, these usually float or are suspended in the electrolyte; but they will also sometimes sink to the bottom of the rotating container, whenever the average specific weight of the individual plastics part is greater or has grown greater than that of the electrolyte or other treating solution in the bath. The specific weights of the plastics themselves are mostly smaller than those of the electrolytes (around 1.040 g./c.c. for ABS-polymers as against 1.120 g./c.c. for a cyanide copper bath or 1.166 g./c.c. for a nickel bath) but the average specific weight of each individual part increases as the electrolessly-deposited metallic coating is built up on the surface of the part. The average specific weight of any part may be calculated as the quotient secured by the division of the sum made up of the weights of the plastics part and its continually-growing metal coating on the one hand by the total body volume of the part on the other hand.

With that in mind, the considerations affecting the problem may be enumerated as follows:

1. Contact Pressure

The force bringing two adjacent plastic parts in the bulk mass together in order to establish electrical contact between them as they are suspended in the electrolyte is extremely small due to the minimal difference between the average specific weight of the metal-coated plastic parts and the specific weight of the electrolyte.

2. Intermixing

In order to ensure the uniform appearance of all the parts in the load after electroplating it is necessary throughout the electroplating operation continuously to alter the position of each part relative to the load as a whole.

3. Relative Movement

Equally, in order to achieve a uniform appearance in the electroplated product it is necessary for the parts to be continuously moving throughout the electroplating operation at differing speeds with respect to each other.

4. Fluid Boundary Layer

Whatever the nature of the plastics part itself, metal surfaces are generally not hydrophobic, and the metal-coated surface of the plastic part is therefore wetted by the electrolyte, which clings to the surface in the form of a layer which moves around with the part at the same speed.

5. Break up of the Electric Field

The efficient electroplating of the rotating load of bulk parts takes place effectively at and in its peripheral zone. The electrical field is formed in the electrolyte between the anode (situated outside the immersed barrel) and the cathodically-polarized load (situated inside the barrel) but this field breaks down - in accordance with the Faraday cage-effect - at the edge of the polarized load, and is able to penetrate this only to an insignificant extent. Thus electroplating is confined practically to the edges of the load.

6. Electrolyte - exchange

A continuous turnover of the electrolyte at the cathode surface is advantageous, particularly as regards the deposition of polished platings, since this avoids impoverishment of the electrolyte adjacent the surface in the metal ions to be deposited and also removes the air bubbles present as well as the gas bubbles arising from the flow of electric current, which can stick to the surface of the bulk parts and cause local impediments to the deposition of the metal. The impoverishment of the electrolyte in the metal ions to be deposited and the formation of gas bubbles both take place principally where the current densities on the cathode are largest that is to say in the edge zones of the load, and thus at the peripheries of the rotating barrel. Thus electrolyte-exchange is particularly important at the peripheral circumference of the rotating tumbling barrel.

The considerations discussed at (1) to (4) above lead to the creation in actual practice of a hypothetically-avoidable film of electrolyte, varying in thickness, between the adjacent bulk parts. The existence of this separating film of electrolyte leads to certain undesirable consequences, as follows:

a. Bi-polar Effects

The electroplating current flows from the anode, constituting the positive pole of the system and situated outside the electroplating tumbling barrel, through the electrolyte in the electroplating bath and through the load (or more strictly through the metal "skin" on the plastics parts) right through to the cathodic contact elements, constituting the negative pole of the system, which are situated in the rotatable tumbling barrel. However when the individual parts are separated ("insulated") from one another by a film of electrolyte then on the individual plastics part the metal coating retains the function of an electrical interconnector, but the part acts as a bi-pole within the load. One area on its metallic surface displays a cathodic potential and another area, electrically-speaking diametrically opposite thereto, displays an anodic potential. Thus local galvanic cells are set up between adjacent plastics parts, oriented in the direction in which the electroplating current flow. Bipolar effects unfortunately cause at least partial electrolytic redissolution of the metal coating (no matter whether deposited electrolessly or galvanically) in those areas of the surface of the parts which (temporarily in the course of the rotational movement) are at anodic potential. Consequently such bi-polar effects lead to the reversal of the desired proper electroplating effects. Moreover, these bi-polar effects also lead to the electrolytic formation of metal oxides on the metallic coating layer during its local, anodic polarization, thereby causing rough and matt surfaces which are unsuitable for purposes of decoration.

b. Unhomogeneous Partition of the Electrical Potential

The electroplating current does not distribute itself uniformly, and anyway its pattern of flow is not easily visible and cannot be controlled. The consequence is a lack of uniformity in the appearance of the bulk parts and - within the limits of the decreasing potential differences of the individual bulk parts with respect to the anode system -also a substantial decrease in the speed of electrolytic deposition, thus in the electroplating performance.

c. Chemical Corrosion

It is impossible completely to eliminate the chemical attack of the electrolyte on the metal coating upon the plastics part in the bath, owing to the breakdown of the electrical field at the edge of the load, and this corrosive effect of the solution is significantly promoted by the existence and extent of the separating films of electrolyte. The resultant corrosion leads to the chemical redissolution of the deposited metal; and almost always also leads to the chemical oxidation of the surface of the deposited metal.

d. Burn Patches

The phenomenon of so-called burn patches occurs either upon the conductive electrolessly-deposited coating or upon the subsequent galvanically-applied electroplating upon the plastic parts. These burn patches appear not as points but are spread over areas which generally cover a considerable part of the surface of the part. Their occurrence can be explained as follows. Galvanic baths mostly are worse electrical conductors than metals; their respective conductive capacities for electricity differ by a ratio whose order of magnitude is about $1:10^5$. As indicated at (a) above, the setting up of local galvanic cells between the adjacent bulk parts is to be expected; and the passage of current is then concentrated (in the region involved in the transmission of current from one part to the other) first of all on a gap which spatially is almost point-shaped, comprising the electrically-opposed, polarized areas of the metal coatings on two adjacent bulk parts and the electrolyte film lying between them. The Joule heat evolved corresponds to the product of the electric current $i$ squared and of the electrical resistance R of the system. The resistance R is minimal if metal bridges are in existence, that is if direct metal contacts have been established between one part of the load and another; but on the other hand the resistance R suddenly jumps if the current conduction has to take place across a bad electrical conductor, to be specific in this case across an intervening film of electrolyte. It ought also to be borne in mind that on the anodic side of the system (consisting of two adjacent bulk parts) redissolution of the metal layer as well as oxidation of the surface is liable to take place; both of these effects lead to impairment of conductivity, for metal oxides are well known to be generally bad electrical conductors. Thus, all these previously-described effects may be superimposed to bring about a localized high total resistance R, and thus an excessive, local generation of heat. This results in dark violet-coloured burn patches and circular spots on the surface of the bulk parts, which may also be partially or completely stripped of their metal covering layer by these electrolytic and thermal reactions. Dark burn patches and de-metallized spots on the bulk parts are not rare occurrences; on the contrary it is a not uncommon experience for anyone with knowledge of this field to encounter a completely failed load, in which virtually all the bulk parts - piece after piece- prove to be unuseable.

The known tumbling barrels include those of prismatic or cylindrical shape arranged to rotate around their horizontal axis of symmetry, which dip only a relatively small part of their volume into the electrolyte and possess an opening centrally-located in one of the two end walls mounted perpendicular to the axis of rotation, this opening serving for loading or unloading the batch of metal bulk parts. Since this opening remains essentially free during the electroplating it need not be covered with a lid. Tumbling barrels of the kind just described are however unsuited for electroplating metallized plastics parts, as these float or are suspended in the electrolytic solution in the bath.

Alternatively, tumbling barrels of prismatic shape with a hexagonal cross-section have been marketed, which similarly rotate about their horizontal axis of symmetry but have an opening for loading or unloading the batch on the peripheral circumference of the casing, which of course must be closed by means of a lid during electroplating. These barrels have a length of about 550 mm. and an average casing diameter of about 200 mm. The electroplating current is carried to the load via two insulated cables which are individually introduced within the barrel through the two axial bearings which support the barrel at or adjacent its end walls, and these cables terminate in smooth, metallic, cylindrical contact elements, about 200 mm. long and about 12 mm. in diameter. This type of tumbling barrel can be used without constructional alteration for electroplating bulk parts no matter whether made of metal or made of plastics - though the conditions of application have to be altered appropriately. When electroplating bulk parts made of metal such tumbling barrels can be immersed completely or nearly completely in the electrolyte, but when electroplating bulk parts made of plastics, then according to Müller, G., "Galvanisieren von Kunststoffen", published by E. G. Leuze Verlag, Saulgau, (1966), pgs. 104–105, one must ".....allow these commercially-available electroplating barrels to be dipped only partially, that is up to one third to 50%. In this way the goods are compelled to pack together at the bottom of the barrel and a more constant contact is established. Since however like this only a very small volume of liquid is effective, the current densities which can be employed are very small, resulting in long treatment times. The constant rising of the contacts out of the liquid leads to the passivation of the electrical contacts." It is in fact standard industrial practice to load tumbling barrels with a batch of parts - irrespective of whether those parts are made of metal or plastics - which fills only from about one third up to at most one half of the space within the barrel. Experience has shown that when filled with larger quantities the intermixing of the load during electroplating becomes unsatisfactory, resulting in unevenly-electroplated bulk parts and very long electroplating times.

A tumbling barrel has been proposed in U.S. Pat. No. 3,330,753 which consists principally of two end walls vertical to the axis of rotation, an outer casing fixed between these end walls and surrounding an inner, concentrically-arranged coaxial cylinder, and several rod-shaped cathode contacts extending between the end walls in the annular space between the outer barrel casing and the inner cylinder. It is there suggested that this annular space within the barrel should be filled as nearly full as possible so long as the bulk parts can still move; the purpose of filling the barrel nearly full is to restrict the room for movement of the plastics parts as much as possible in order to force them to the opposite electrical contact.

However, this has its disadvantages. As explained at (5) above, the electrical field breaks up at the peripheral circumference of the large-volume load. Since the majority of the bulk parts lie within the conglomerate mass they consequently are effectively shut off from the galvanic plating process, and as explained at (a), (c) and (d) they run increased risk of bi-polar effects, of chemical corrosion by the electrolyte, and of the formation of burn patches. Moreover, it is also easy to see the irregular distribution of the electrical potential field in the load, explained at (b) above, when such a tumbling barrel is put into use. Thus for example when the bulk parts are relatively small, by opening the barrel lid and reaching into the load one can clearly see that the bulk parts near the peripheral circumference have already been plated with electrolytically-deposited metal at a time when parts located well inside of the batch have been electroplated only very slightly or even not at all. This means at best that extremely long electroplating times are needed, while the platings produced on the bulk parts in the load are liable to look uneven, varying from matt to brightly-shining.

Tumbling barrels have been proposed in German Pat. Nos. 277,128 and 281,032 whose length is smaller than their diameter, and whose end walls normal to the axis of rotation are perforated. The barrel according to German Pat. No. 277,128 has a peripheral casing of metal, which serves as the cathode contact element for the batch loaded into the barrel. The direct current needed for electroplating is led to the casing via a flexible metal band, which extends more than half way around the electrically-conductive barrel casing and at the same time holds the barrel in its operative rotating position. The barrel according to German Pat. No. 281,032 makes cathodic contact with the batch via a metal hoop fastened on the inside of the peripheral barrel casing. The direct current needed for electroplating is led to the contact hoop along several radially disposed spokes, which radiate from a metal driving wheel (for rotating the barrel) secured concentrically with the barrel.

However the two different sorts of tumbling barrels proposed in German Pat. Nos. 277,128 and 281,032 have not found favour in industrial practice, for several reasons. The current-conducting elements of the barrels (the flexible band, the spokes and the driving wheel) all quickly become covered with electrolytically-deposited metal, since the electrical resistance between them and the anode system tends to be much smaller than that between the cathodically-polarized load enclosed within the barrel and the same anode system. As a direct consequence of this unwanted metal deposition the barrel in each case may become incapable of functioning mechanically within quite a short time.

A further important reason for the practical failure of the tumbling barrels just described above lies in the deviation of the electroplating current away from the load of bulk parts. The tendency is for most of the electroplating current to flow to the barrel elements at cathodic potential (flexible band, spokes and driving wheel) so that only a fraction of the electroplating current flows to the barrel and reaches the load, because the cathodic contact elements (the contact casing and the metal hoop) on the periphery of the barrels not only display a higher potential difference but also have a more favourable position with respect to the anode system than the load. As explained at (5) above, the electroplating process takes place at the edge of the load; and from this it is self-evident that the disposition of the contact-casing and -hoop on the outside of these conventional barrels causes them to draw a considerable part of the remaining galvanic current to themselves, to the detriment of the load. For the reasons explained at (a), (b), (c) and (d) above, the resultant galvanic platings will tend to be rough and matt, possibly dark-violet and of generally differing aspect, so that one gets a possibly useless product even after very long electroplating times.

Yet another disadvantage of these same conventional tumbling barrels derives from the fact that, as previously indicated they are filled with the load only to about a third of their volume. There is consequently only a small specific contact pressure between the individual bulk parts made of plastics and between these bulk parts and the cathodic contact elements. This inadequate contact pressure is a direct result of filling not more than a third of the volume of the barrel, and it leads to bi-polar effects and an irregular electrical potential field in the load, thus causing burn patches on the bulk parts, chemical re-dissolution of the deposited metal coatings and hence a regular percentage of supposedly electroplated parts in the load which have to be rejected as useless.

The tumbling barrel according to German Pat. No. 277,128 is particularly unsuitable for electroplating plastics parts, since one of its features is the division of its volume into self-contained compartments.

As explained at (5) above, the electrical field breaks up, as is well known at the peripheral circumference of the load - and the galvanic reaction thus takes place practically only at the edge of the conglomerate of bulk parts. If by F [expressed in $dm^2$] one denotes the external surface (the surface of the peripheral circumference) of the load, and by V [expressed in $dm^3$] one denotes its volume, then the quotient F/V [$dm^2/dm^3$] defines the specific average value and thus the proportion of the electroplating current I per unit of space of the volume of the load. If the value of this specific quotient F/V is relatively high, then the speed with which electroplating takes place in the barrel is likewise proportionally high. All the conventional tumbling barrels are however characterized by low specific average values F/V of the electroplating current I. This common disadvantage is of extreme importance from a chemical engineering standpoint; it leads to very long electroplating times, and therefore small electroplating throughputs per barrel. This applies just as much when the load consists of metal parts as when it consists of plastic parts.

SUMMARY OF THE INVENTION

It is an object of this invention to provide a novel construction of tumbling barrel such that with a single, standard barrel structure and with a consistent method of application the barrel will fulfil the optimum functional requirements which are necessary for electroplating bulk parts made either of plastics or of metals - and which of course is also easy, robust and efficient to build and operate.

It has now been found that these objectives can be largely or wholly secured by combining three essential features of design, namely:

i. the length of the barrel measured parallel to the axis of rotation must be less than the diameter of the barrel measure normal to the axis of rotation, using the term "diameter" to represent, in drums with a polygonal casing cross-section, an average value between the greatest and the smallest distances of the polygonal sides from their centre of symmetry;

ii. the end walls of the barrel, usually normal to the axis of rotation, must be provided with perforations; and iii. the barrel must contain an inner peripheral wall, or tube of generally cylindrical cross-section, located within the peripheral casing and co-axial with the axis of rotation.

According to the invention there is provided a tumbling barrel for containing a batch of electrically conductive parts to be electroplated, which barrel comprises a pair of spaced apart end walls;

a generally cylindrical outer peripheral wall extending between the two said end walls and attached thereto at its ends;

a generally cylindrical inner peripheral wall extending between the end walls co-axially within the outer peripheral wall, the inner peripheral wall being attached to the end walls at its ends, the inner and outer peripheral walls and end walls together defining an annular treatment chamber;

at least one closable opening in the outer peripheral wall to allow the loading and unloading of parts into and out of the treatment chamber;

cathodic contact means for supplying electric current to parts contained within the treatment chamber; and means mounting the end walls for rotation about the common axis of the inner and outer peripheral walls;

both end walls and the outer peripheral wall having formed therein a multiplicity of perforations and the length of the barrel measured parallel to its rotational axis being significantly less than the average diameter measured normal to its rotational axis.

It will of course be appreciated that the end walls are preferably arranged normal to the axis of rotation of the barrel, and that the peripheral wall or casing and inner peripheral wall or tube while generally cylindrical, may in fact be prismatic.

Using a tumbling barrel of this construction, the batch of bulk parts is loaded into the generally annular treatment chamber between the peripheral casing of the barrel and the inner tube; and as will be apparent from what is said later, it is desirable that the batch should fill approximately two-thirds of this generally annular space within the barrel, so as to attain maximum effectiveness of the electroplating.

None of the known tumbling barrels displays the combination of the three features which characterize the barrel according to this invention; and it is an astonishing fact by adopting these features, i.e. reversing the generally-accepted proportionality between length and diameter of the barrel, by perforating the end walls and by arranging a central inner tube within the barrel it suddenly becomes possible to achieve both quantitative and qualitative improvements, above all in the electroplating of metallized plastic parts.

The astonishing advantages of the barrel construction according to this invention have been demonstrated by comparative tests. Taking the nearest comparable counterpart as the known barrel described in U.S. Pat. No. 3,330,753, which has a length of 300 mm. and a diameter of 220 mm., a barrel was built in accordance with the teachings of this invention which had a length of 90 mm. and a diameter of 400 mm.. Thus the volume of the two barrels was the same, namely 11.5 $dm^3$; and they were filled with equal sized batches (2.8 kg. batch-weight, 5.8 $dm^3$ volume of the batch) of identical bulk parts, namely buttons made of ABS-polymer (an acrylonitrile-butadiene-styrene co-polymer). Each batch was then electroplated in a shiny nickel-plating electrolyte using the same electroplating-currents and -times and the same number of revolutions of the two barrels under test. The bulk parts nickel plated in the barrel according to the invention showed a high-gloss and uniform spotless appearance, and none of the batch needed to be rejected. On the other hand the bulk parts nickel-plated in the conventional barrel though predominantly glossy showed more or less matt and matt-shiny tinges in the central area of the disc-like buttons, while about 5% of the batch were rejects, and even the remainder were not really satisfactory in appearance on a strict, qualitative criterion. The qualitative improvement in the electroplated coatings produced by the barrel according to the invention was also confirmed by taking sections through individual bulk parts. Moreover, sampling of the bulk parts, by periodically removing some from the barrel according to the invention during the electroplating, showed that their plating was essentially complete after only about 35 minutes as compared with the 70 minutes needed in the known comparison barrel.

A further interesting observation concerns the magnitude of the direct current voltage; maintaining the same electroplating current in both barrels, the electroplating voltage in the barrel according to the invention fell to one third of that needed in the conventional barrel. The results observed are summarized in the following Table, which gives a synopsis of the electroplating times *t*, the electroplating currents I and the associated direct current voltages U; the voltages for the barrel according to the invention are denoted by the index *n*, and those for the known barrel by the index *b*. The electroplating current I varied with time, and in fact increased proportionally to the growth in diameter of the metal coating layers on the plastics parts.

| t | I | $U_n$ | $U_b$ |
|---|---|---|---|
| 20 mins. | 25 Amps | 2.5 Volts | 3.5 Volts |
| 10 " | 45 " | 2.5 " | 4.5 " |
| 10 " | 70 " | 3.5 " | 5.5 " |
| 30 " | 110 " | 4.5 " | 6.5 " |

The empirical observations recorded above lead to the astonishing conclusion that the spatial shape of the barrel contributes materially to an improvement in the current conduction from one part to another and from the parts in bulk to the cathode contact elements. From this it follows that the new construction of barrel here proposed must in some way greatly increase the specific contact pressure previously discussed at (1) above, and/or it must decrease or eliminate the electrolyte film between the individual parts previously discussed at (4) above and thereby eliminate the disadvantageous bi-polar effects discussed at (a) above, and/or it must homogenize the electrical potential field in the load previously discussed at (b) above, and/or it must impede the chemical corrosion of the metal coatings on the plastics parts previously discussed at (c) above, and/or it must eliminate the cause of the burn patches previously discussed at (d) above.

The barrel according to this invention is very desirably filled in such a way that the batch of bulk parts completely covers the inner tube with the result that the surface area of the outside of the batch attains its maximum value relative to its volume. This yields a favourable proportionality between the surface area of the outside of the batch and its volume, and thus leads to high specific average values of the electroplating current per unit volume of the batch, so that the resulting electroplating times for the barrel according to the invention are consequently very short.

It has moreover been found that the best results from a chemical engineering standpoint can be obtained if the barrel, irrespective of whether the batch consists of metal-parts of plastics-parts, is immersed completely or almost completely in the electrolyte. If the parts are made of metal (or in the case of plastics parts if they are so heavy that they sink to the bottom of the barrel) then their location beneath the surface of the electrolyte - together with the associated anode system - makes it possible to form an electrical field of high homogeneity, enveloping the periphery of the batch on all sides.

The use of an inner tube within the outer casing of the barrel is an extremely important feature of the invention. It is preferably hollow, though it can be solid, and although it will normally have a circular cross-section, it may in fact have a polygonal cross-section. It must of course extend from one end wall of the barrel to the other, and thus will rotate synchronously with the body of the barrel around the common axis of symmetry.

The advantages which flow from the presence of an inner tube within the tumbling barrels of this invention are as follows:

A. Batch Size Increase

The generally annular space within the barrel can and should be filled approximately two-thirds full with the bulk parts. Bearing in mind that a batch of plastics or metal parts will either float or sink in the electrolyte, compelling the space in either the uppermost or the lowermost zone of the generally completely immersed barrel to fill up, it will be appreciated that the inner tube will then be completely surrounded by a batch of plastic parts floating in the electrolyte but on its underside - as may be seen along the line *m—n* in FIG. 2 of the drawings mentioned subsequently herein - the inner tube is covered only by a thin layer of the bulk parts. Exactly the same effect is obtained, in an inverted position, when the bulk parts are heavier than the electrolyte and sink to the bottom of the barrel. The doubled quantities in each batch which filling the barrel two-thirds full makes possible means that the throughput capacity of the barrel can be more or less doubled for this reason alone.

B. Intensive Intermixing of Parts

So long as part of the generally-annular space within the barrel remains unoccupied, the inner tube ensures intensive intermixing, since the parts slide over the inner tube (along the line *m—n* in FIG. 2 of the subsequently-mentioned drawings) and thus alter their position both relative to one another and inside the batch as a whole. Improved intermixing means improved uniformity and quality of the metal coatings on the bulk parts.

C. Fixed Position of Batch

Except when it is rolling and intermixing with the other bulk parts as it passes through the intermixing gap (along the line *m—n* in FIG. 2), every part keeps its position inside the conglomerate of bulk parts both with respect to the adjacent parts and with respect to the casing of the barrel and the cathode contact elements, throughout the duration of each revolution. In other words, the batch does not as a whole carry out any relative movement with respect to the casing of the barrel; and this "fixed" position (for about two-thirds of the treating time) more or less eliminates all displacements between the individual parts lying one against the other. Consequently it seems that the thickness of the disadvantageous electrolyte film between adjacent parts (and between the bulk parts and the cathode contact elements) as previously discussed at (4) above must be considerably reduced, or indeed the film may be actually broken and penetrated by direct bodily contact between the adjacent parts, i.e. formation of direct electrical contacts between the parts across metal bridges. However abrasive damage to the extremely thin, electrolessly-deposited metal layer (generally about 0.8 $\mu$m thick, just sufficient to make the surface of the plastics parts electrically conductive) as well as partial redissolution thereof due to chemical and electrolytic influences must be reduced to a minimum, particularly in the first, critical phase of the electroplating process. Furthermore, the causes and the occurrence of the bi-pole effects, as previously discussed at (a) above, which normally afflict the mass-electroplating of plastics parts, and the passivation of the cathode contact elements (in consequence of too high current densities) seem to be all ruled out.

D. Increase in Specific Electrical Contact Pressure

The contact pressure between the floating or sinking bulk parts is very slight, as previously discussed at (1) above, but it is of fundamental importance for the conduction of relatively high electroplating currents, generally exceeding 100 amps. The doubling of the size of the batch causes the average specific contact pressure between the bulk parts to increase approximately in direct proportion. The doubled buoyancy-force (with floating bulk parts) or sinking-force (with sinking bulk parts) contributes materially to an accelerated and reliable operation of the electroplating process.

E. Increased Electroplating Current

The annular spatial distribution of the batch in the barrel and the comparatively large diameter of the casing of the barrel together result in an approximate doubling of the outside areas of the batch, and thus makes it possible more or less to double the electroplating current and thus, for this reason alone, to achieve an approximate doubling in the electroplating throughput capacity of the barrel.

The advantages (A) to (E) set forth above are those which result from the presence of the third characteristic feature of the invention, namely the inner tube, when electroplating bulk parts made of plastics or metal using the optimum conditions, thus when the barrel is completely immersed in the electrolyte (particularly with floating plastics parts where the completely immersed barrel prevents the bulk parts which rise buoyantly upwards from projecting out of the electrolyte and being thereby removed from the electroplating process) and when also the batch of bulk parts at least partially covers the surface of the inner tube.

The advantage of the second characteristic feature of the invention, namely the perforation of the end walls, lies in the fact that this opens a path for the electroplating current in an area which is obstructed in the known barrels for electroplating plastics parts, and by opening this path integrates the peripheral zones of the batch adjacent to the end walls of the barrel into the galvanic deposition process.

Basing the calculation upon the dimensions of the previously-described test barrel according to the invention, which is 90 mm in length and 400 mm in diameter, the opening up of the peripheral zones of the batch adjacent to the two end walls results in an approximately threefold effective increase in the electroplating output. The peripheral surface of the barrel casing is 11.3 $dm^2$ in extent, while the area of each end wall is 12.8 $dm^2$, and the volume of the barrel is 11.5 $dm^3$. Thus the specific mean value F/V [$dm^2/dm^3$] of the electroplating current when the end walls are not perforated is $F/V = 11.3\ dm^2/11.5\ dm^3 = 0.98\ dm^2/dm^3$; but the specific mean value F/V of the electroplating current when the end walls are perforated is $F/V = 36.9\ dm^2/11.5\ dm^3 = 3.21\ dm^2/dm^3$. In this particular case the specific mean value F/V of the electroplating current per unit volume of the batch, and thus the speed of the electrolytic deposition, can thus be seen to be increased threefold by the perforation of the end walls of the tumbling barrel according to the invention.

In an electroplating installation utilizing the tumbling barrels of the invention it is best if the anodes are arranged parallel to the perforated end walls of the barrel(s), since it has been found that this arrangement leads to a homogeneous distribution of the electrical field in the electrolyte between the rows of anodes and the peripheral zones of the batch adjacent the perforated end walls of the barrel. The large anode surfaces which result from spreading the anodes out along the two end walls of the bath opposite the perforated end walls of the barrel contribute moreover to the fact that the anodic current densities - despite the very large electroplating currents - are evenly distributed, thus do not exceed their permitted limit, and consequently do not give rise to passivating phenomena at the anodes. The fact that anodes and cathodes are then effectively arranged parallel to each other corresponds to the ideal arrangement for which one should always strive when constructing galvanic cells or systems.

It is also preferred to arrange electroplating installations in accordance with this invention with additional anodes disposed parallel to the axis of rotation of the barrel. These additional anodes not only provide some contribution to the increase in the electroplating current but more importantly they help in homogenising the electrical field in the peripheral area of the barrel.

An electroplating installation in accordance with this invention, consisting of a tumbling barrel as herein described and rows of anodes parallel both to the end walls and to the barrel casing, leads to an electrical field of exceptional evenness over the whole periphery of the barrel. The barrel, which is preferably immersed completely in the bath of electrolyte, is surrounded on all sides (both around the perforated end walls and also around the perforated casing) by anodes and consequently is enveloped by an electrical field of high homogenity, so that the batch is subjected to an intensive and even electroplating process over its whole surface. These favourable conditions lead to very high electroplating currents at technically permissible cathodic and anodic current densities as well as low voltages, as much with metallic parts as with plastics parts - and make it possible to secure qualitatively superior platings at extraordinarily high electroplating speeds.

As previously discussed at (5) above, the electrical field breaks down at the peripheral zones of the batch, and can only penetrate into them to a very limited extent. However the perforated end walls offer the advantage that the field can spread into the batch from two diametrically opposed sides (the two end walls) and in view of the short length of the barrel can work its way sufficiently deeply into the interior of the batch to be of some technical importance.

For this reason it is preferred that the length $l$ of the barrel, measured parallel to its axis of rotation, should be less than half the diameter D of the barrel, measured normal to its axis of rotation. This further shortening of the length $l$ intensifies the penetration of the batch by the electric field entering from both perforated end walls, and also promotes effective intermingling of the bulk parts during the rotational movement.

A further advantage of the tumbling barrel according to the invention is the effectiveness with which it intermingles the bulk parts, no matter whether these are made of metal or plastics. The free surface of the batch within the barrel is inclined in the direction of rotation (in the case of floating plastic parts roughly as shown by the straight line $m$—$n$ in FIG. 2; and in the case of sinking metal or plastic parts in the inverted position) and therefore the individual bulk parts roll loosely, up or down as the case may be, along the line *m—n* or its inverted counterpart. The unusually large diameter of the barrel forces each part to roll a long way and thus enforces intensive intermingling of the parts.

Naturally it will be appreciated that bulk parts surrounded by the electrolyte behave like all bodies immersed in a liquid, i.e. they are acted upon by an upwards buoyancy force equal to the weight of the electrolyte they displace and also by a counteracting downwards gravitational force. The unusually large diameter of the barrel according to the invention, approximately twice that of the comparable conventional barrels, means that with similar proportionate filling-amounts - for instance two-thirds of the volumes of the barrels - the bulk parts pile up above one another about twice as high as in the conventional barrels. Whether it is the buoyancy force or the gravitational force which is predominant, thus whether the bulk parts stacked vertically above one another are seeking to float or to sink, it must follow that the higher is the "pile" of bulk parts the larger will be the resulting average contact pressure within the batch. Consequently, taking an actual case, if the diameter of the barrel according to the invention is twice as large as that of a known one of comparable volume and if these two barrels are for instance each filled with bulk parts to two-thirds of their volume, then the average batch amount - and consequently the mean specific contact pressure between the plastic parts - is approximately twice as large in the barrel according to the invention as in the known one, no matter whether the bulk parts in question are such as float or sink. This illustrates the fact that the barrel according to the invention achieves high contact pressures between the individual batch parts during the electroplating of plastics parts, which is one of the decisive functional requirements needed to avoid the defects previously discussed at (a), (b), (c) and (d).

The end walls are of large extent and for mechanical strength need to be substantially thicker than need be the barrel casing usually some five to six times stronger. On the other hand, the perforations in the end walls are generally directed horizontally, and of course fill with electrolyte when the barrel is immersed in the bath. In order to prevent too much electrolyte from being dragged out of the bath when the barrel is removed, the length of the perforation holes proper should be kept fairly short. A value of 12 mm. might be set as the maximum desired length for the perforations. This imposes a maximum thickness on the end walls, or at least on those regions thereof which contain the perforation holes proper. It will be recognized that this arrangement precludes large losses of electrolyte by drag-out when changing the barrel from one bath to the next and also helps minimize contamination of the electrolyte(s) and/or other treatment solutions.

The inner tube often can conveniently consist of an electrically non-conductive material, and in this case is preferably hollow and mostly provided with perforations. The electrical field established between the cathodically-connected batch and the rows of anodes can then pass through the hollow perforated inner tube and thus penetrate the peripheral zone of the batch adjacent this inner tube. Perforating the hollow inner tube consequently increases the size of the active peripheral areas of the batch, and thus increases the electroplating output of the barrel.

When the bulk parts to be electroplated, no matter whether made of metals or of plastics, have a specific weight very different from that of the electrolyte, and thus are either very buoyant or just the reverse, then it is usually advantageous to form the inner tube as a cathodic contact element. The same also applies when the individual bulk parts have relatively large dimensions, and it is therefore desirable to keep the annular space between the barrel casing and the inner tube free from any kind of obstruction (thus free too from other cathodic contact elements) in order not to interfere with the intermingling process.

However, when the bulk parts to be electroplated have a specific weight closely similar to that of the electrolyte, and thus have no strong tendency either to float up or to sink down, it is then usually advantageous to arrange an annular or part-annular cathodic contact element within the annular space between the peripheral barrel casing and the inner tube (here, like the outer barrel casing made of an electrically non-conductive material) and conveniently this should be arranged mid-way therebetween and concentrically therewith. This annular or part-annular cathodic contact element, which no matter whether closed or open can for convenience be called a contact ring, may be arranged either to rotate with the barrel or to remain stationary.

It will of course be recognized that it is possible to form the inner tube of electrically-conductive material, thus to use it as a cathodic contact element, and also to provide additional cathodic contact elements (for instance closed or open contact rings) in the inner space of the barrel as well.

The incorporation of a closed or open annular contact ring into the tumbling barrel of this invention helps to achieve, in conjunction with the other features herein described, most or all of the following desirable objectives in the electroplating of bulk parts made of plastics, namely so far as possible:

the greatest possible extent of the surface of the batch exposed to plating;

the distribution as evenly as possible of the maximum permissible cathodic current densities over virtually the whole batch surface;

the location within the batch of cathodic contact elements having the largest possible surfaces;

the establishment of the shortest possible paths for the electro-plating current within the batch from its peripheral zones to the cathodic contact elements; and the promotion of the highest possible contact pressures between the bulk parts themselves and between them and the cathodic elements.

The two end-walls will preferably have a smooth interior surface and thus the opening for loading and unloading the barrel is preferably located at the peripheral circumference of the barrel, thus in the barrel casing and therefore must always be closed during electroplating with a removable lid.

When the barrels according to this invention are likely to be used for electroplating plastics parts then they should generally be provided with two openings located on the peripheral casing of the barrel diametrically opposite one another. Experience with conventional barrels has shown that when lifted out of the bath of electrolyte individual plastics parts due to their slight weight when wetted with water tend to remain adhering loosely to the walls of the barrel and thus can delay quick, complete unloading of the batch. However, when the barrel according to the invention is provided with two openings it is possible to rotate one of them into its lowermost position, and to empty the bulk parts through it by introducing a jet of water through the upper, second opening.

Conventional tumbling barrels are usually rotated at about 8 revolutions per minute or perhaps more - but high speeds of revolution cause high relative speeds between neighbouring bulk parts, which has disadvantages. If the parts are made of plastics, then bipole effects may arise and consequently through partial anodic polarisation of the galvanic platings these may acquire rough and/or matt surfaces. If the batch consists of metallic parts such as screws, electronic constructional elements or other relatively delicate bulk parts, then relatively high speeds of rotation can lead to mechanical damage through percussive action. It is an advantage of the barrels according to the invention that their large diameter permits low speeds of revolution without detriment to the degree of batch-intermingling. Consequently it is preferred to operate the barrels according to the invention at rotational speeds of less than 8 revolutions per minute. Although some deviation of the rotational axis of the barrel from horizontal is of course permissible, it has been found that substantial deviations from the horizontal are unsuitable for achieving an intensive intermingling effect. Thus it is to be assumed that the axis of rotation of the barrel will be directed horizontally or almost horizontally.

The overall shape of the tumbling barrels according to this invention, owing to their small length and large diameter, is thus disc-shaped. This makes possible a further advantageous and important embodiment of the invention, in which two, three or even more of the barrels are mounted coaxially and parallel to one another in a row upon separate axes or preferably upon a common axis so that they rotate synchronously. The coacting barrel units thus formed may be termed "double" or "triple" barrels etc. as the case may be, and these multiple-barrel units represent a substantial advance as opposed to the known ones - such as for instance that described in U.S. Pat. No. 3,038,851 which discloses a complicated and thus expensive yet electrolytically rather ineffective design of "quadruple" barrel. The multiple-barrel units according to the invention would be used in conjunction with rows of anodes arranged between the individual barrels forming the unit, these additional rows of anodes being of course mounted parallel to the end-walls. It is of course clear that the individual barrels in such a multiple-barrel unit can be filled simultaneously with batches of various kind(s) and size(s) of bulk parts - and thus for instance in a double barrel unit one might simultaneously electroplate batches of bulk parts made on the one hand of metals and on the other hand of plastics.

BRIEF DESCRIPTION OF THE DRAWINGS

In order that the invention may be well understood it will now be further explained, though only by way of illustration, with reference to the accompanying drawings, in which.

DESCRIPTION OF THE PREFERRED EMBODIMENTS

Figure 1:
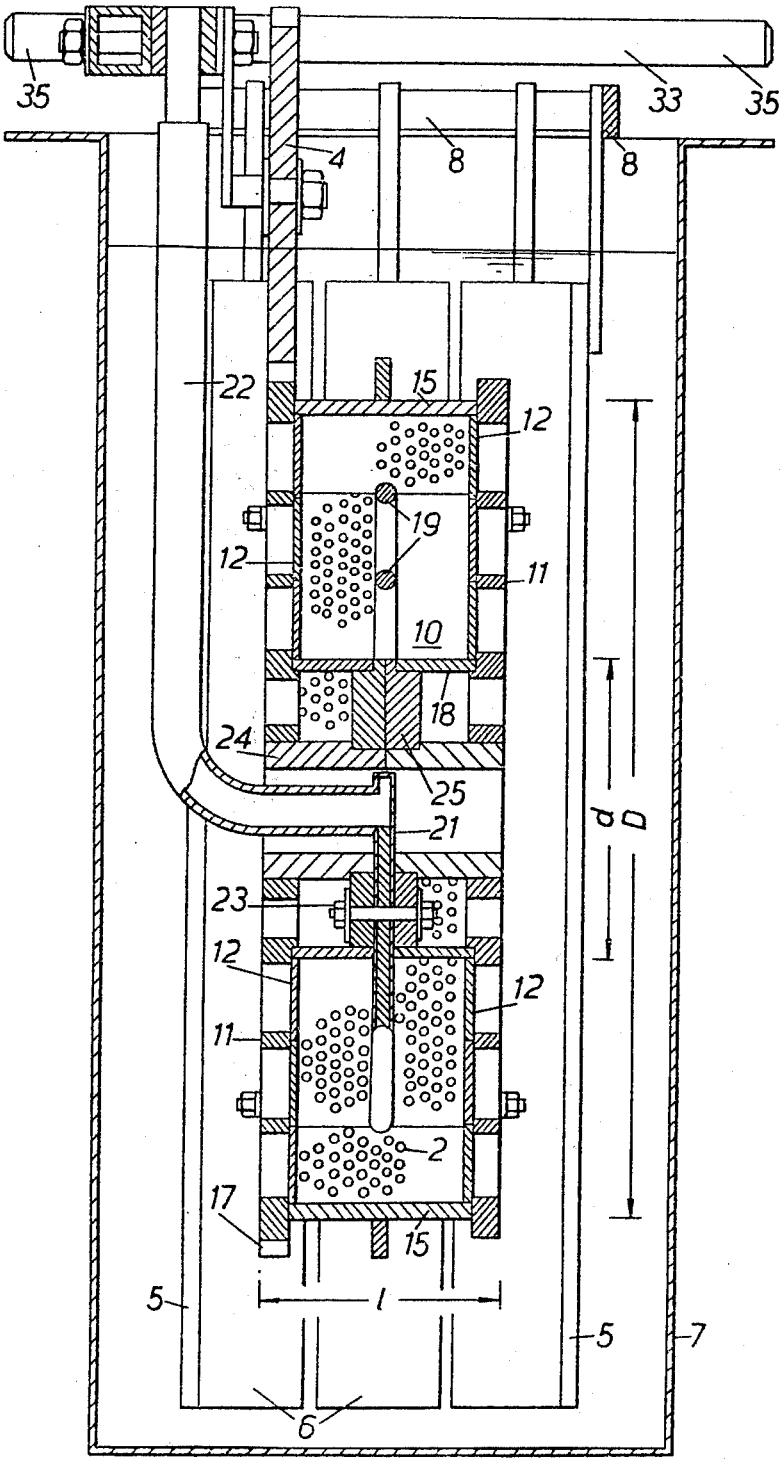
FIG. 1 shows a longitudinal cross-section through one preferred embodiment of tumbling barrel according to the invention, which is particularly suitable for electroplating bulk parts made of plastics.
Figure 2:
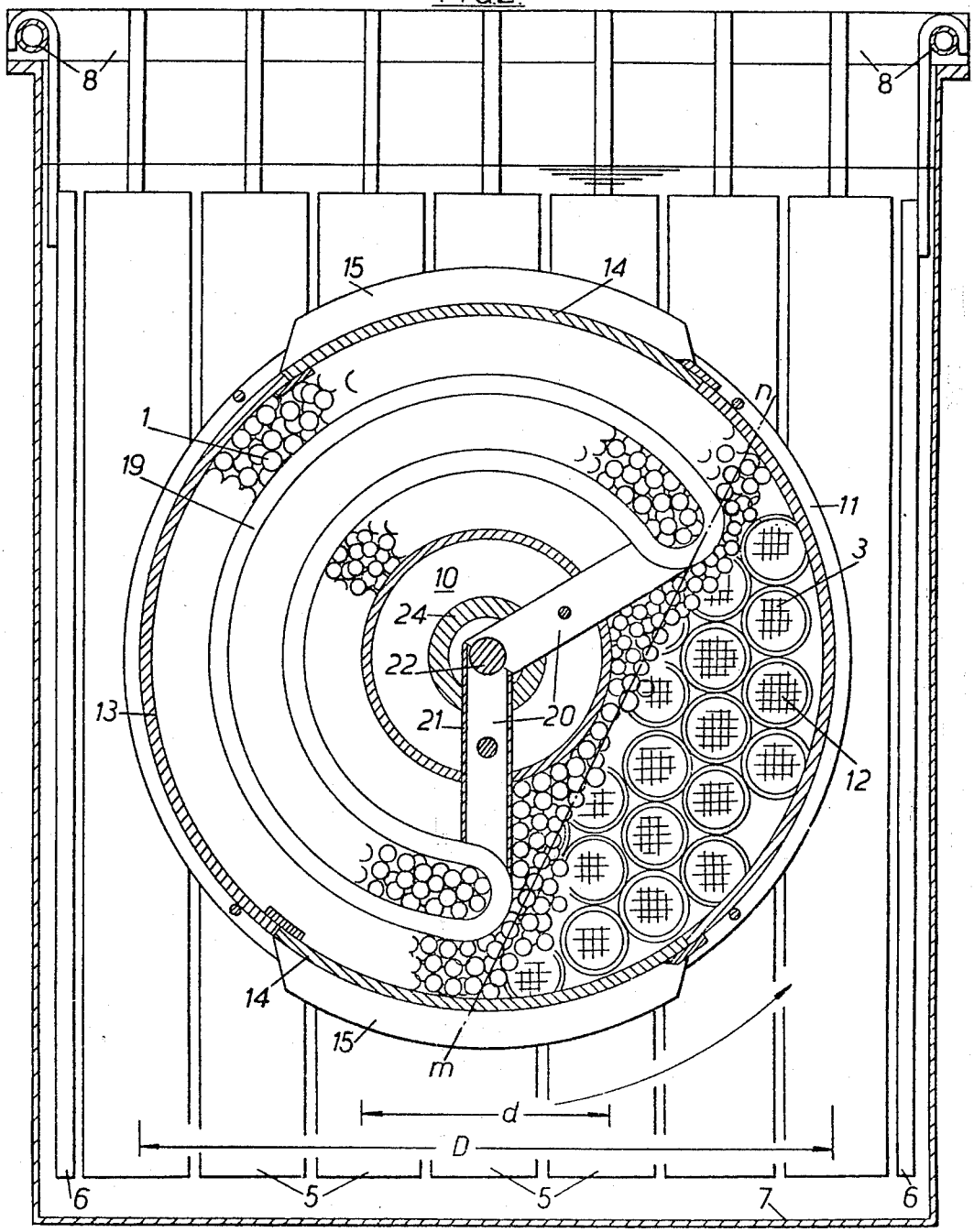
FIG. 2 shows a transverse cross-section through the embodiment of FIG. 1.
Figure 3:
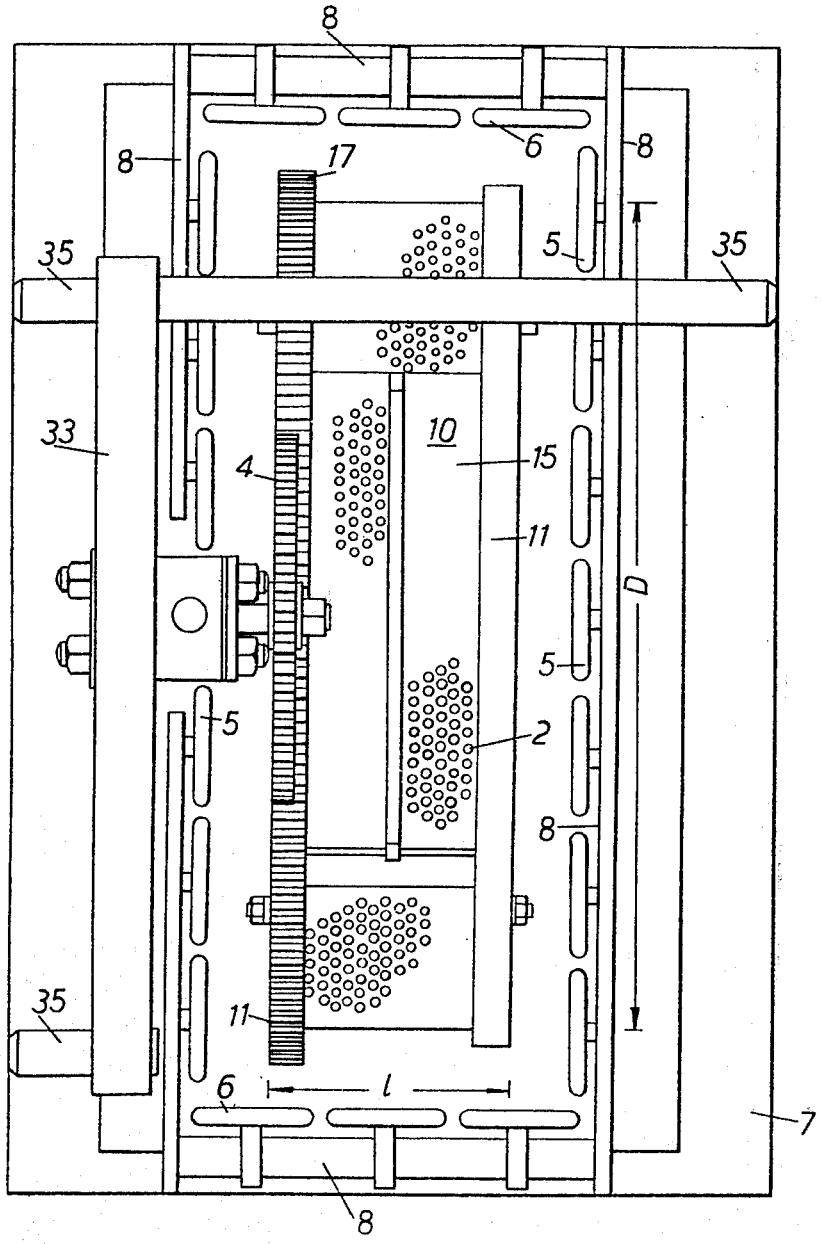
FIG. 3 shows a plan view of the embodiment of tumbling barrel shown in FIG. 1.

Referring first to FIGS. 1–3, and especially FIG. 2, the tumbling barrel there shown contains a batch 1 of bulk parts which are made of plastics and float in the electrolyte. The individual bulk parts in the batch 1 will each, once in every revolution of the rotational movement of the barrel, roll upwards roughly along the line *m—n*, becoming thereby thoroughly intermingled with the other plastics parts. Although when the bulk parts are made of metal and thus sink in the electrolyte the position of the line *m—n* must be inverted about the barrel centre this does not affect the principle of operation; and all the tumbling barrels here described with reference to FIGS. 1–6 of the accompanying drawings may be used without alteration of construction or procedure for electroplating bulk parts made of plastics as well as of metals.

The barrel as a whole is generally indicated at 10, and while it may have a prismatic overall shape of polygonal cross-section it is here shown as a cylinder of circular cross-section, with a pair of spaced parallel end-walls 11, which are perforated. To enable the length of the horizontal perforations to be less than the overall thickness of the end-walls 11, the latter may as shown be furnished with large cylindrical holes, arranged honeycomb fashion, in which perforated disc-shaped inserts 12 are fastened.

Figure 4:
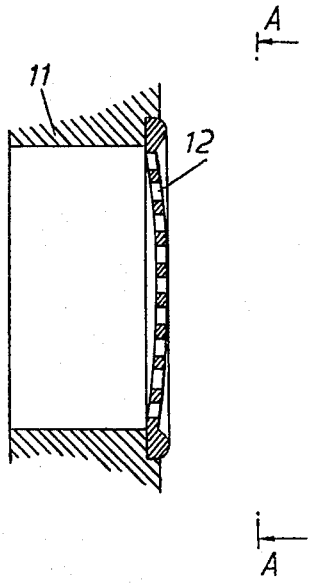
FIG. 4 shows a cross-sectional view of a perforated, disc-shaped insert (which is fastened in the end-walls of the barrel)
Figure 5:
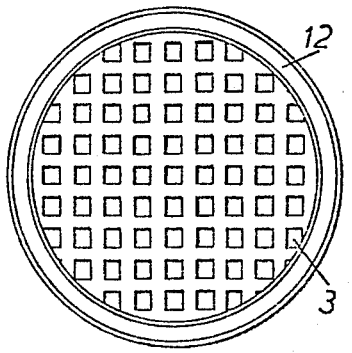
FIG. 5 shows an elevational view of the insert shown in FIG. 4 and taken on the line A—A in that Figure.

FIGS. 4 and 5 show the most important details of such a disc-shaped insert 12, which has a reinforced circular rim and whose face is curved so that it is concave towards the interior of the barrel 10, in order to accommodate any mechanical pressure exerted by the batch 1 against the insert and to transmit it by elastic deformation to the end-wall 11. It may be noted that these perforated, disc-shaped inserts 12 can generally best be made by injection moulding from some electrically non-conductive material; and they may be secured in the large cylindrical holes in the end-walls 11 by mechanical pressure, by welding or sticking, or possibly in some other interchangeable manner. Of course, the large cylindrical holes in the end-walls 11 can be covered over in other ways, for instance by an extruded grid made of plastics wires.

Between the end-walls 11 there extends an outer peripheral barrel casing 13, fixedly connected at each end to the end-walls 11, formed of some electrically non-conductive material, and provided with perforations.

The letter *l* in FIG. 1 indicates the length of the tumbling barrel, measured parallel to the axis of rotational symmetry, while the letter D in FIG. 2 indicates the diameter of the barrel, measured normal to that axis. In accordance with this invention the length *l* must always be smaller than the diameter D; but it is especially advantageous when the length *l* of the barrel is less than half its diameter D, as shown in FIGS. 1, 3 and 6.

Figure 6:
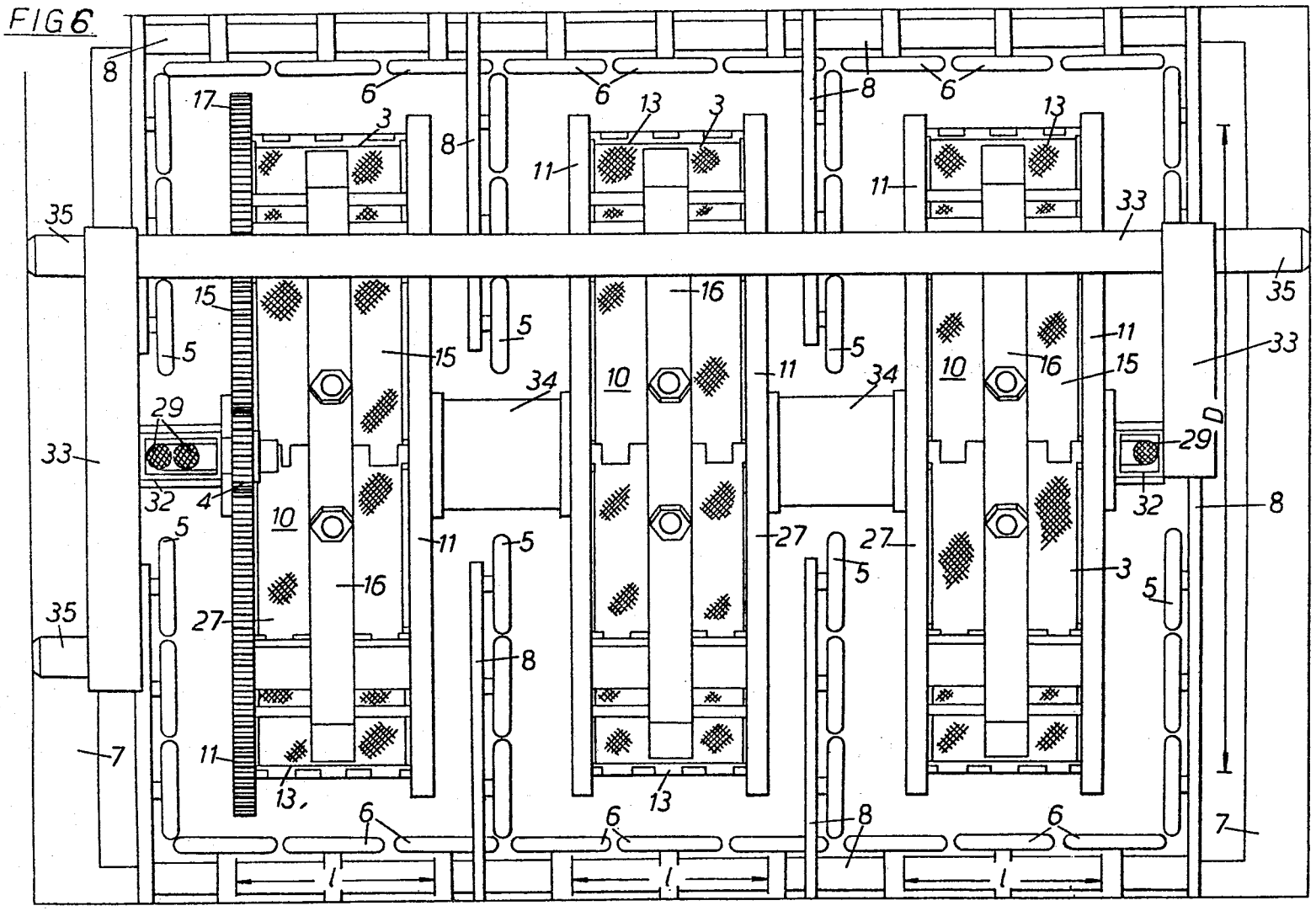
FIG. 6 shows a plan view of a so-called triple-barrel unit according to the invention.

In FIGS. 1 and 3, circular perforations in the barrel casing 13 are indicated by groups of small circles identified with the reference numeral 2, while in FIGS. 2 and 4 perforations of square cross-section in the end-walls 11 are indicated by square hatching identified with the reference numeral 3, as too are the square perforations in the barrel casing 13 of FIG. 6.

The barrel casing 13 is equipped with one or more openings 14 in order to permit the barrel 10 to be loaded with the batch 1 or unloaded again. These openings 14 are closed during electroplating with removable lids 15, which are perforated and are often conveniently secured to the barrel casing 13 with elastically sprung strips 16 made for instance of titanium. In the embodiment of FIGS. 1–3 the barrel 10 is equipped with two diametrically-opposite openings 14, in order to facilitate and accelerate the unloading procedure for the batch 1.

The circumference of one of the two end-walls 11 is formed as a gear-wheel 17 which is driven via the driving cog 4 from a motorised drive and motor source (not shown) thus rotating the entire barrel.

The end-walls 11, the barrel casing 13 and the lids 15 are made of electrically non-conductive materials which are chemically stable in the various electrolytes or other treatment solutions to be employed.

As shown in FIGS. 1, 2, 3 and 6, besides the tumbling drum the installation includes two different sets of anodes, firstly a row of anodes 5 parallel to the end-walls 11 and secondly a row of anodes 6 parallel to the axis of rotation of the barrel 10. The four rows of anodes 5 and 6 surround the barrel 10 on all sides in the horizontal plane.

The perforated inner tube 18 as shown in FIGS. 1 and 2 preferably consists of an electrically non-conductive material and is arranged coaxially within the barrel casing 13, extending from one end-wall 11 to the opposite one. The diameter of the cylinder 18 is indicated by the letter *d*. As shown, this inner tube 18 is mounted to rotate synchronously with the end-walls 11 and the barrel casing 13, but it can also be fixedly mounted so that it does not rotate with the barrel 10. As can be seen from FIG. 2, the ratio of the diameter *d* of the inner tube to the diameter D of the outer tube is of the order of one-third.

Although they should be smooth in the sense of free from obstructions, the inner surfaces of the end-walls 11, of the casing 13 and of the inner tube 18 can all advantageously be profiled (i.e. shaped unevenly in some manner, for instance with a pyramidal or corrugated screen pattern) in order to prevent the bulk parts from readily adhering when wet to these surfaces.

As can best be seen from FIG. 2, a cathode-contact 19 is located within the barrel casing 13, which transfers the electroplating current to the batch 1. This generally annular open-ring contact 19 is in fact a sort of double crescent shape, and has a large contact surface. The contact ring 19 can be mounted either so that it rotates synchronously with the barrel 10 or stationarily so that it does not. The contact ring 19 preferably forms a complete ring concentrically fastened between the casing 13 and inner tube 18. The supporting legs 20 of the cathode element 19 are insulated against the electrolyte and the electrical field by means of a chemically-stable, electrically non-conductive sheath 21.

In FIGS. 1, 2 and 3 the barrel 10 is supported by a carrying arm 22 whose end is bent at right angles to form a horizontal stub axle. The disc-shaped and tubular constructional elements 24 and 25 are fastened to the two supporting legs 20 with screw connections 23, and these elements are made of a plastics material suitable for an axle bearing upon which the barrel 10 (consisting of the two end-walls 11, the casing 13, the two lids 15 and the inner tube 18) can rotate. The contact ring 19, the supporting legs 20 and the bent carrying arm 22 form a seamless, continuous, rigid metallic body, which serves the dual function of mechanically supporting the barrel and enabling it to be lifted in and out of the electrolyte, as well as conducting the electroplating current. The carrying arm 22 is also protected by insulation 21, and helps to establish the connection between the direct current source and the negative pole.

It is possible, within the scope of the invention, to use the inner tube 18 as a cathodic contact element. The tube 18 is then made of a conductive material and forms a so-called cylinder-contact which transfers the electroplating current to the batch 1. The metallic cylinder 18 can then be supported, for instance, on the two supporting legs 20; and must then be chemically and electrically insulated against the electrolyte by means of sheath 21.

FIG. 2 shows a floating batch 1, which fills the inner space of the barrel approximately two-thirds full and completely (on all sides) covers the inner tube 18. The batch 1 is of optimum size when the tube 18 is just covered by the bulk parts 1 and sufficient room remains unoccupied for the intermingling procedure to take place freely. During rotation of the barrel the bulk parts 1 roll over the tube 18 (along the line *m—n*) and intermingle excellently.

FIG. 6 shows a multiple-barrel unit according to the invention in which three parallel-mounted barrels rotate about a common axis. The individual barrel casings 13 (and lids 15) consist of plastics sheets 27, having at their ends offset inter-engaging lugs joined and held together with bolts. The sheets 27, which are conveniently made by injection moulding, say from polypropylene, and are therefore interchangeable cheaply, are here provided with square perforations 3. The lid 15 is likewise formed from two such sheets 27, and is removably secured to the barrel casing 13 by means of a flexible closure 16 made of springy titanium strip.

If the barrel is to be used for larger metal parts and for plastics parts of higher mean specific weight, then its diameter can advantageously be very large, for instance D = 600 mm. while its length might then be $l$ = 150 mm.

The electroplating current flows to the batch 1 from the direct current source via the insulated cable 29.

The end-walls 11 are provided with bearing bushes which rotate on the common axis of the triple-barrel unit of FIG. 6. At its ends this common axis is supported by two vertically arranged carrying arms 32, formed of titanium tubes of square or rectangular cross-section. The gear wheel is attached only to the barrel 10 mounted adjacent the cog 4; but the rotational movement imparted to the first barrel 10 by means of the gear wheel 17 is transferred to the other two barrels 10 of the triple-barrel unit by the couplings 34.

The support arms 32 (or the barrel-carrying arm 22 of FIG. 1) are each rigidly fixed to a support frame 33 which, together with the barrel(s) 10, forms a transportation unit - for instance a triple-barrel unit. The frame 33 is provided with appropriate mechanical and electrical fittings 35 to enable it to be placed upon the projecting rims of the electrolyte baths 7 and to be connected up to the direct current source when the barrel 10 is thus immersed in the electrolyte.

While the barrel according to the invention has been specially designed for electroplating it is in fact also suitable and indeed advantageous when used for etching and for electrolessly metal-coating batches of plastics parts and also for so-called anodically polishing of metallic parts in bulk.

If the barrel 10 is used for etching, for electroless metal-coating and for subsequent electroplating of batches 1 made of plastics, then the individual treatment steps of etching, of electroless metal-coating and finally electroplating the batch 1 (in that order) can be carried out in one and the same barrel 10. It is therefore unnecessary on conclusion of electroless metal-coating to reload the batch 1 from one barrel which is suitable only for etching and electroless metal-coating into another barrel which is suitable only for carrying out electro-plating.

Although as so far described the tumbling barrel of this invention is not so provided, there is no reason why either a soluble or an insoluble inner anode should not be mounted within the inner tube 18 when this is as preferred perforated and formed of an electrically non-conductive material.

If the barrel 10 is used for anodically polishing metallic bulk parts, then pole-reversal takes place at the batch 1, the contact element 19 and the electrodes 5 and 6. This means that the batch 1 together with the now anodic contact element 19 form the positive pole, while the formerly anodic electrodes 5 and 6 in the bath 7 now form the cathodes, thus the negative pole of the system. If there was an inner anode, this must now be converted to an inner cathode. This clearly is an improvement over the practices of the prior art as evidenced for instance by Austrian Pat. No. 222,454.

It will be noted that the barrel 10 is immersed in an electrolyte or other treatment solution which is contained in the bath 7. The horizontal line in the upper region of the baths 7 in FIGS. 1 and 2 symbolises the height of this liquid level.

It should also here be noted that the circular and square perforations 2 and 3 should be grouped together as densely as reasonably possible, in order to form as large an open "entrance" in the end-walls 11, in the casing 13 and in the lid 15 as possible, because a large entrance area, say of more than 15% of the whole barrel surface, permits high electroplating currents to enter the barrel and helps to maintain an even current distribution in the peripheral zones of the batch 1.

I claim:

1. An electroplating tumbling barrel for containing a batch of electrically conductive parts to be electroplated, which barrel comprises a pair of spaced apart end walls;

a generally cylindrical outer peripheral wall extending between the two said end walls and attached thereto at its ends;

a generally cylindrical inner peripheral wall extending between the end walls co-axially within the outer peripheral wall, the inner peripheral wall being attached to the end walls at its ends, the inner and outer peripheral walls and end walls together defining an annular treatment chamber;

at least one closable opening in the outer peripheral wall to allow the loading and unloading of parts into and out of the treatment chamber;

cathodic contact means for supplying electric current to parts contained within the treatment chamber; and means mounting the end walls for rotation about the common axis of the inner and outer peripheral walls;

both end walls and the outer peripheral wall having formed therein a multiplicity of perforations and the length of the barrel measured parallel to its rotational axis being not more than one-half the average diameter measured normal to its rotational axis.

2. An electroplating tumbling barrel according to claim 1, in which anode supporting means are provided to support anodes extending parallel to said end walls and exteriorly of the barrel.

3. An electroplating barrel according to claim 2, in which further anode supporting means are provided to support further anodes extending parallel to said rotational axis and exteriorly of the barrel.

4. An electroplating barrel according to claim 1, in which the inner peripheral wall is provided with a multiplicity of perforations.

5. An electroplating barrel according to claim 1, in which said cathodic contact means comprises an electrically conducting annular contact element mounted co-axially within the treatment chamber.

6. An electroplating barrel according to claim 1, in which the ratio of the diameters of the inner peripheral wall to the outer peripheral wall is of the order of 1 to 3.

7. An electroplating tumbling barrel for immersion electroplating of a batch of electrolessly metal-coated plastics parts, which barrel comprises:

a pair of spaced apart end walls;

a generally cylindrical outer peripheral wall extending between the two said end walls and attached thereto at its ends;

a generally cylindrical inner peripheral wall extending between the end walls co-axially within the outer peripheral wall, the inner peripheral wall being attached to the end walls at its ends, the inner and outer peripheral walls and end walls together defining an annular treatment chamber;

at least one closable opening in the outer peripheral wall to allow the loading and unloading of parts into and out of the treatment chamber;

cathodic contact means for supplying electric current to parts contained within the treatment chamber, said cathodic contact means comprising an electrically-conducting annular contact element mounted co-axially within the treatment chamber;

means mounting the end walls for rotation about the common axis of the inner and outer peripheral walls; and anode supporting means for supporting anodes exteriorly of the barrel extending parallel to said end walls and also extending parallel to said rotational axis; said end walls and the outer peripheral wall and the inner peripheral wall having formed therein a multiplicity of perforations, and the length of the barrel measured parallel to its rotational axis being not more than one-half the average diameter measured normal to its rotational axis.

8. An electroplating tumbling barrel for containing a batch of electrically conductive parts to be electroplated, which barrel comprises:

a pair of spaced apart end walls;

a generally cylindrical outer peripheral wall extending between the two said end walls and attached thereto at its ends;

a generally cylindrical inner peripheral wall extending between the end walls co-axially within the outer peripheral wall, the inner peripheral wall being attached to the end walls at its ends, the inner and outer peripheral walls and end walls together defining an annular treatment chamber;

at least one closable opening in the outer peripheral wall to allow the loading and unloading of parts into and out of the treatment chamber;

cathodic contact means for supplying electric current to parts contained within the treatment chamber; and means mounting the end walls for rotation about the common axis of the inner and outer peripheral walls;

and in which both end walls and the outer peripheral wall and the inner peripheral wall are provided with a multiplicity of perforations and the inner peripheral wall is electrically-conducting and serves as said cathodic contact means and the length of the barrel measured parallel to its rotational axis is not more than half of the diameter measured normal to its rotational axis.

* * * * *